US006753841B2

(12) United States Patent
Kai et al.

(10) Patent No.: US 6,753,841 B2
(45) **Date of Patent: *Jun. 22, 2004**

(54) METHOD AND APPARATUS FOR DRIVING LIQUID CRYSTAL DISPLAY PANEL

(75) Inventors: Tsutomu Kai, Kawasaki (JP); Yoshiya Kaneko, Kawasaki (JP)

(73) Assignee: Fujitsu Display Technologies Corporation, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/250,575

(22) Filed: Feb. 16, 1999

(65) Prior Publication Data

US 2002/0122041 A1 Sep. 5, 2002

(30) Foreign Application Priority Data

Mar. 18, 1998 (JP) ..... 10-069071

(51) Int. Cl.[7] ..... G09G 3/36

(52) U.S. Cl. ..... 345/99; 345/100; 345/204; 348/458

(58) Field of Search ..... 345/99, 100, 87, 345/204, 127–130, 132–698, 699; 348/458

(56) References Cited

U.S. PATENT DOCUMENTS 4,054,385 A * 10/1977 Wheable ..... 356/138
5,448,259 A * 9/1995 Hidaka ..... 345/99
5,894,299 A * 4/1999 Tsuchiya et al. ..... 345/100
5,895,935 A * 4/1999 Yamazaki et al. ..... 257/59
6,118,429 A * 9/2000 Kasai et al. ..... 345/428

* cited by examiner

*Primary Examiner*—Amare Mengistu
*Assistant Examiner*—Jimmy H. Nguyen
(74) *Attorney, Agent, or Firm*—Greer, Burns & Crain, Ltd.

(57) ABSTRACT

An LCD apparatus has a control circuit 40 which makes a timing of the rear edges of scanning pulses provided to predetermined scanning lines coincide with the time when the display potential is renewed, wherein each of the predetermined scanning lines corresponds to an addition of a picture line to a picture or a reduction from two picture lines to one picture line on a picture in order to compensate for a difference between the number of scanning lines of the LCD and the number of lines of the picture to be displayed. In the control circuit, a circuit detects cycle times of the vertical and horizontal sync pulses, an MPU determines the reference value REF on the basis of the detected value and count CH of the horizontal sync pulse *HS from a counter, and a circuit generates a signal AE which makes the time when the pulse count CD of pixel clock CLKD from the counter becomes equal to the REF that coincides with the timing of the rear edge of scanning pulse.

13 Claims, 13 Drawing Sheets

SIGNAL PROCESSING
20
VA
VB
DATA DRIVER
30
CLKD
SPD,LCH
CONTROL
40
*HS
*VS
SCANNING DRIVER
50
CLKG
SPG,AE
DLj
SLi
VC
12
11
10 LCD PANEL

3/4 TIMES CONTRACTED DISPLAY

3/2 TIMES ENLARGED DISPLAY

4/3 TIMES ENLARGED DISPLAY

METHOD AND APPARATUS FOR DRIVING LIQUID CRYSTAL DISPLAY PANEL

BACKGROUND OF THE INVENTION

1. Field of the Invention

The present invention relates to a liquid crystal display apparatus, control circuit thereof, and a method for driving a liquid crystal display panel.

2. Description of the Related Art

A computer is able to select one of a plurality of resolution powers (dot matrix construction) and output its video signals. To the contrary, the dot matrix construction of a liquid crystal display is fixed.

Therefore, for example in FIG. 12(A), in order to display video data of VGA (640×480 pixels), XGA (1,024×768 pixels) or SXGA (1,280×1,024 pixels) with the full screen by a liquid crystal display panel of SVGA (800×600 pixels), it is necessary to process digital picture images with a memory, a memory control circuit and a digital filter circuit added to the liquid crystal display. Accordingly, such problems arise, by which the production cost is increased, the mounting area of parts is increased, and consumption power is also increased.

In order to solve these problems, in a case where the number of picture lines is multiplied by three-fourths, for example, as shown in FIG. 12(B), one picture line may be omitted for every four picture lines. However, in a picture, for example, a black line and a white line are alternately disposed, the lines may be made thicker or thinner, and a smooth display can not be obtained. As shown in FIG. 12(C), in a case where the number of picture lines is multiplied by fourth-thirds, one picture line may be doubly added for every three picture lines. However, the line may be also made thicker or thinner as in the case of omitting, and a smooth display can not be obtained.

SUMMARY OF THE INVENTION

In view of the above problems, it is an object of the present invention to provide a liquid crystal display apparatus, control circuit thereof, and a method for driving a liquid crystal display panel, which have a simple construction and are able to smoothly display images by increasing or decreasing the number of display lines in order to display in enlargement or contraction.

In the 1st aspect of the present invention, there is provided a liquid crystal display apparatus, comprising: an active matrix type liquid crystal panel in which potentials of respective data lines are applied to respective display electrodes of a selected display line via respective switching devices of the selected display line, the selected display line corresponding to a selected one of scanning lines; a data driver for applying the potentials to the respective data lines and renewing the potentials at every horizontal cycle; a scanning driver for providing scanning pulses to the respective scanning lines in line-sequence; and a control circuit for causing a timing of the rear edge of a scanning pulse provided to a predetermined scanning line to coincide with a time when the potentials of the data lines is renewed, wherein the predetermined scanning line is one corresponding to an addition of picture line to or a reduction of picture line from a picture to be displayed, in order to compensate a difference between the number of the scanning lines and that of picture lines of the picture to be displayed.

With the 1st aspect of the present invention, with a simple construction without a digital filtering, etc., it is possible to further smoothly display a picture than in a prior art where adding duplicated picture lines to or reducing picture lines from a picture since each of the display potentials of the respective pixels of the scanning line corresponding to the addition or reduction of picture line is made to a potential between the display potentials of the adjacent pixels on the adjacent scanning lines.

In the 2nd aspect of the present invention, there is provided a liquid crystal display apparatus as defined in the 1st aspect, wherein the control circuit comprises: a first counter counting pulses of a clock signal and initialized by a horizontal synchronization pulse; and a pulse rear edge timing circuit for setting the timing of the rear edge at a time when a count of the first counter is equal to a first value.

With the 2nd aspect of the present invention, since the timing is determined with a digital circuit, it is possible to avoid an adjustment deviation depending on the variation of temperature or characteristics of circuit elements.

In the 3rd aspect of the present invention, there is provided a liquid crystal display apparatus as defined in the 2nd aspect, wherein the clock signal is a pixel clock signal.

With the 3rd aspect of the present invention, since a pixel clock is commonly used for a data driver and a control circuit, it is not necessary to generate an additional clock.

In the 4th aspect of the present invention, there is provided a liquid crystal display apparatus as defined in the 2nd aspect, wherein the control circuit further comprises: a second counter counting the horizontal synchronization pulses and initialized by a vertical synchronization pulse; and wherein the pulse rear edge timing circuit executes the setting when a count of the second counter is equal to a second value.

In the 5th aspect of the present invention, there is provided a liquid crystal display apparatus as defined in the 4th aspect, further comprising a reference value determination circuit for detecting cycle times of the horizontal synchronization pulse and the vertical synchronization pulse and for determining the first value on the basis of the detected cycle times and a count of the second counter.

With the 5th aspect of the present invention, since the 1st value can be suitably determined on the basis of these detection values and the count of the 2nd counter, the construction of the control circuit can be simplified.

In the 6th aspect of the present invention, there is provided a liquid crystal display apparatus as defined in the 2nd aspect, wherein the scanning driver comprises: a shift register in which a selection bit is shifted by one bit at every scanning pulse; an output buffer circuit having outputs connected to respective the scanning lines; and a timing adjustment circuit for determining an output of the output buffer circuit on the basis of a parallel output of the shift register and an output of the pulse rear edge timing circuit.

In the 7th aspect of the present invention, there is provided a liquid crystal display apparatus as defined in the 6th aspect, wherein the timing adjustment circuit causes the output buffer circuit to generate the scanning pulse corresponding to a bit of the parallel output when this bit becomes the selected bit and to disappear the scanning pulse when a binary output of the pulse rear edge timing circuit becomes active.

With the 7th aspect of the present invention, the construction of a timing adjustment circuit can be simplified.

In the 8th aspect of the present invention, there is provided a liquid crystal display apparatus as defined in the 1st aspect, wherein the timing in the control circuit approximately coincides with a time point when the display potential becomes the center between the maximum and minimum display potentials in a same polarity.

In the 9th aspect of the present invention, there is provided a control circuit for use in a liquid crystal display apparatus, the control circuit causing a timing of the rear edge of a scanning pulse provided to a predetermined scanning line to coincide with a time when potentials of data lines is renewed, wherein the predetermined scanning line is one corresponding to an addition of picture line to or a reduction of picture line from a picture to be displayed, in order to compensate a difference between the number of the scanning lines and that of picture lines of the picture to be displayed.

In the 10th aspect of the present invention, there is provided a method of driving a liquid crystal display panel, comprising the steps of: providing an active matrix type liquid crystal panel in which potentials of respective data lines are applied to respective display electrodes of a selected display line via respective switching devices of the selected display line, the selected display line corresponding to a selected one of scanning lines; applying the potentials to the respective data lines and renewing the potentials at every horizontal cycle; providing scanning pulses to the respective scanning lines in line-sequence; and causing a timing of the rear edge of a scanning pulse provided to a predetermined scanning line to coincide with a time when the potentials of the data lines is renewed, wherein the predetermined scanning line is one corresponding to an addition of picture line to or a reduction of picture line from a picture to be displayed, in order to compensate a difference between the number of the scanning lines and that of picture lines of the picture to be displayed.

In the 11th aspect of the present invention, there is provided a method as defined in the 10th aspect, wherein the step of the causing includes the steps of: initializing a first count with a horizontal synchronization pulse and counting clock pulses to get the first count; initializing a second count with a vertical synchronization pulse and counting the horizontal synchronization pulses to get the second count; and setting the timing of the rear edge at a time when the first and second counts become first and second values, respectively.

In the 12th aspect of the present invention, there is provided a method as defined in the 10th aspect, wherein the step of the causing includes the steps of: initializing a first count with a horizontal synchronization pulse and counting clock pulses to get the first count; initializing a second count with a vertical synchronization pulse and counting the horizontal synchronization pulses to get the second count; and setting the timing of the rear edge at a time when the first and second counts become first and second values, respectively.

In the 13th aspect of the present invention, there is provided a method as defined in the 11th aspect, wherein the step of the causing further includes the steps of: detecting cycle times of the horizontal synchronization pulse and the vertical synchronization pulse; and determining the first value on the basis of the detected cycle times and the second count.

In the 14th aspect of the present invention, there is provided a method as defined in the 11th aspect, wherein the timing in the step of the setting approximately coincides with a time point when the display potential becomes the center between the maximum and minimum display potentials in a same polarity.

Other aspects, objects, and the advantages of the present invention will become apparent from the following detailed description taken in connection with the accompanying drawings.

BRIEF DESCRIPTION OF THE DRAWINGS

FIGS. 2(A) and 2(B) are time charts showing schematic operations of the display shown in FIG. 1, wherein FIG. 2(A) shows a signal reversing in every frame, and FIG. 2(B) shows the potential changes on one data line in an odd frame and an even frame in a case where a white line and a black line are alternately displayed;

DESCRIPTION OF THE PREFERRED EMBODIMENTS

Figure 1:
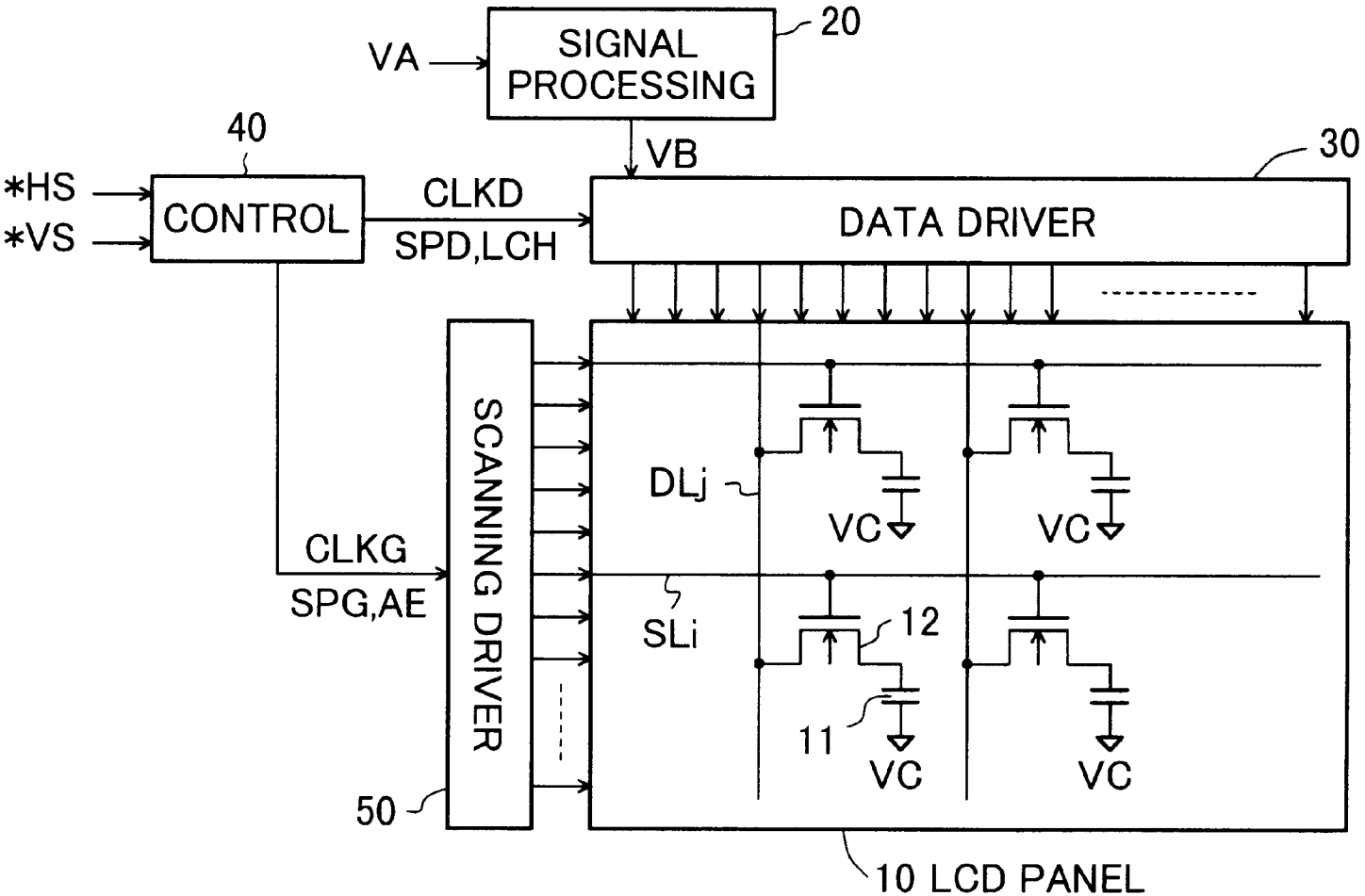
FIG. 1 is a schematic diagram showing a liquid crystal display apparatus according to a first embodiment of the present invention.

Referring now to the drawings, wherein like reference characters designate like or corresponding parts throughout several views, preferred embodiments of the present invention are described below.

First Embodiment

FIG. 1 is a schematic diagram of a liquid crystal display apparatus of a first embodiment to which the present invention is applied.

In an LCD panel 10, the transparent opposing electrode to which the common potential VC is applied is entirely coated on one of the opposing glass substrates, and transparent display electrodes are formed in a matrix on the other glass substrate, wherein liquid crystal is filled and sealed between the glass substrates. Thereby liquid crystal pixels 11 are formed in a matrix. On the display electrode side glass substrate, a TFT 12 is formed corresponding to each of the display electrodes, and a data line DLj and a scanning line Sli are formed with an insulating film between them. The TFT 12 is connected between the data line DLj and the display electrode of the liquid crystal pixel 11 while the gate of the TFT 12 is connected to the scanning line Sli.

Figure 2A:
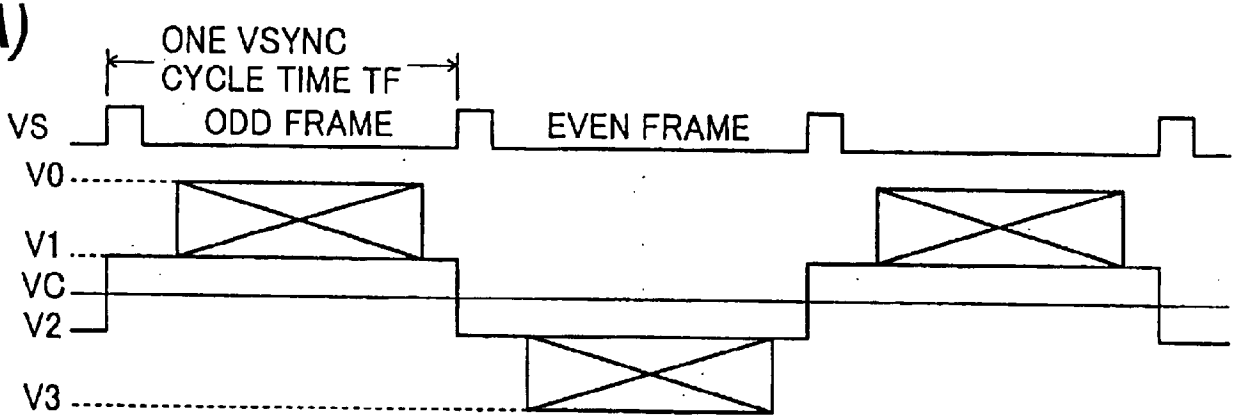

Digital or analog video signal VA is provided from a computer (not illustrated) to a signal processing circuit 20, and then converted to analog video signals VB for the display electrode. VB are provided to a data driver 30. In order to prevent the liquid crystal from being deteriorated, it is necessary to apply alternate voltage to the liquid crystal pixels. Therefore, the polarity, with reference to the common potential VC, of the video signals VB is reversed at every frame as shown in, for example, FIG. 2(A). In FIG. 2(A), potential between V1 and V2 is a non-sensitivity zone of the liquid crystal pixels, V0 and V3 are the potentials of positive and negative polarities, respectively, in the case of the maximum amplitude. For example, V0 is 15V, V1 is 12V, VC is 10V, V2 is 8V and V3 is 5V, respectively.

On the basis of signals coming from a control circuit 40, the data driver 30 applies video signals VB to the data lines DL1 to DLn simultaneously every time when the data driver 30 holds one picture line of video signals VB. Thereby, the display potential of the data lines DL1 to DLn is renewed per cycle (1H) of horizontal synchronization signal *HS. Horizontal synchronization signal *HS and vertical synchronization signal *VS for video signals VA are provided from the above-mentioned computer to the control circuit 40. A scanning driver 50 provides the scanning lines SL1 to SLm with scanning pulses respectively in line-sequence on the basis of signals from the control circuit 40.

When the scanning pulse has been provided to the scanning line SLi, the i-th display line becomes a selected one, wherein the TFT12 is turned on, and the potential of the data line DLj is applied to the display electrode of the liquid pixel 11 via TFT12. At the transiting time point when the scanning line SLi is turned from its selected state to its non-selected state, that is, at the time point when the scanning pulse is at its rear edge, for each j the potential of the data line DLj is held at the display electrode of the liquid crystal pixel 11 for one cycle (1V) of the vertical synchronization signal *VS.

Figure 2B:
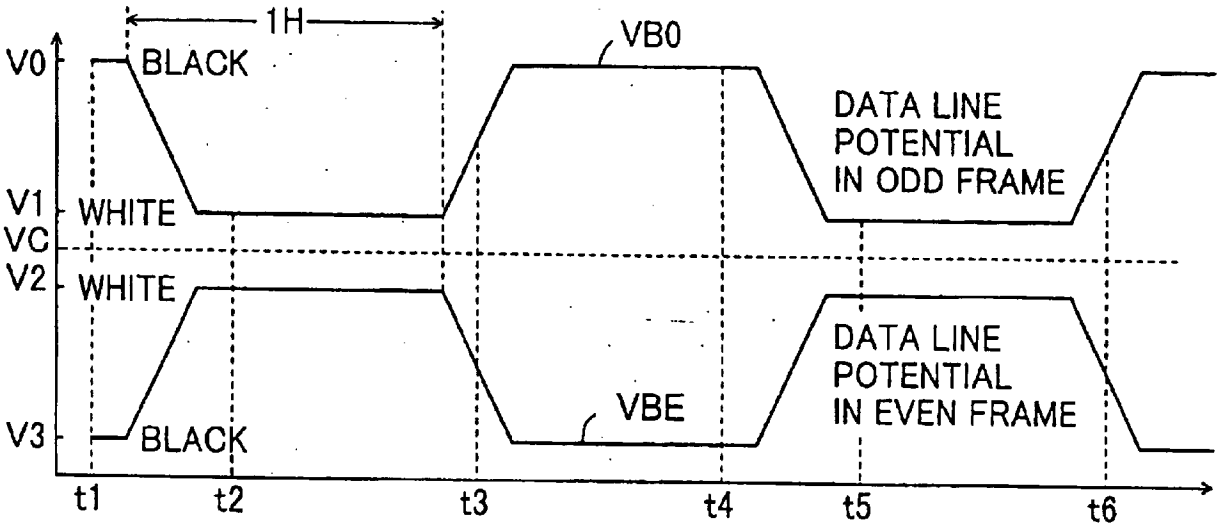

In a case where, for example, black and white lines are alternately displayed on the LCD panel 10 from the top to the bottom of the panel 10, the potential of one data line DLj changes such as VBO or VBE shown in FIG. 2(B), depending on whether the frame is an odd frame or an even frame. One cycle of the display potential VBO and VBE is equal to 2H. The transmittancy of liquid crystal with respect to the application voltage are reversed according to the kind of liquid crystal. Assume that the liquid crystal pixels are made black when the display potential is V0 or V3, and white when the display potential is V1 or V2 in this embodiment.

For example, the resolution power of a picture with video signals VA to be displayed is SVGA, VGA, XGA or SXGA while the LCD panel 10 is of SVGA specification, n=800 and m=600. In a case where the number of picture lines of the picture with VA is different from the number of scanning lines of the LCD panel 10 and a VA picture is to be entirely displayed on the LCD panel 10, it is necessary to add or reduce the number of picture lines of the picture with VA.

Assume a case where the number of picture lines to be displayed is added and, for example, the ratio of the number of picture lines to form a picture with video signals VA and the number of scanning lines of the LCD panel 10 is 2:3. In this case, the scanning lines SL1 through SL6 are made transitional from the selected state to the non-selected state at each of time points t1 to t6 in FIG. 2(B). That is, the timing of the rear edge of the scanning pulse to be provided to each of the predetermined scanning lines of all ones in the LCD panel 10 is set to the time point when the display potentials of the data lines DL1 to DLn are updated. Herein, "predetermined scanning lines" in the LCD panel 10 are the ones corresponding to the addition in a case where picture lines are added to the VA picture in order to compensate a difference between the number of scanning lines of the LCD panel 10 and the number of picture lines to form a picture to be displayed with video signals VA. In other words, the scanning line corresponding to the addition is made transitional from its selected state to its non-selected state at the points t3 and t6 of the time when the display potentials of the data lines DL1 to DLn are changed, in order that each of the display potentials of the respective pixels of the scanning line corresponding to the addition is made to a potential between the display potentials of the adjacent pixels on the adjacent scanning lines, preferably, made middle therebetween, that is, average thereof.

Figure 3A:
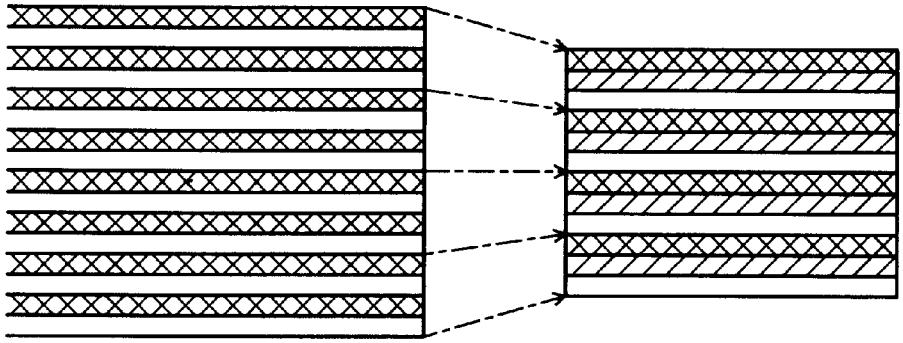
FIGS. 3(A) and 3(B) are views illustrating three-fourth time display and three-second time display, respectively.
Figure 3B:
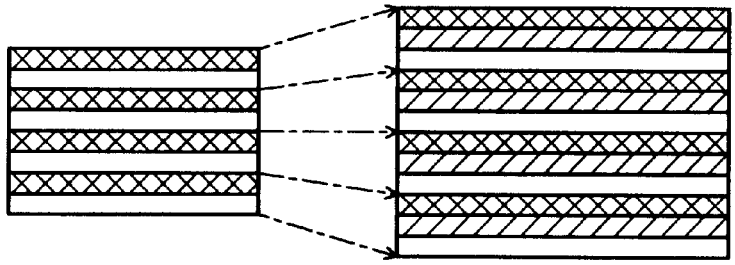
Figure 12A:
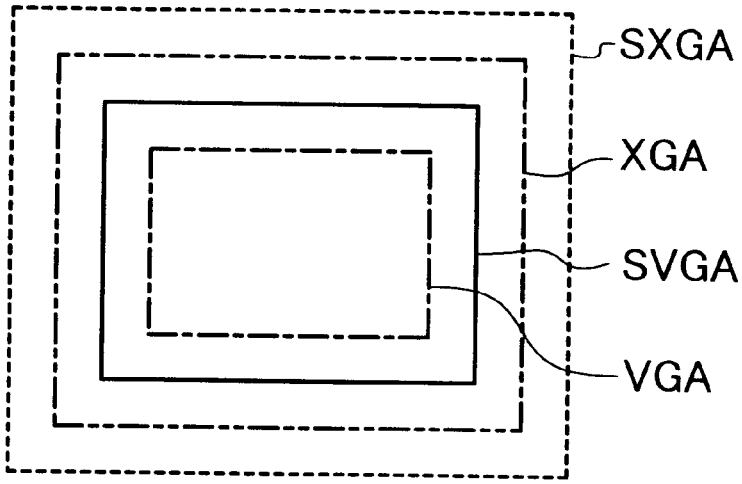
FIG.12(A) PRIOR ART
FIGS. 12(A) through 12(C) are views illustrating prior art problems.
Figure 12B:
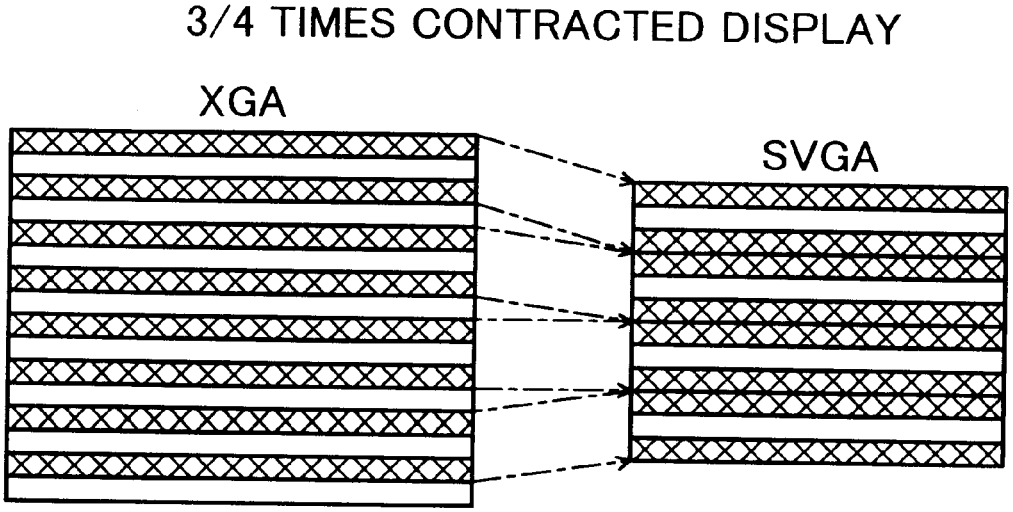
FIG.12(B) PRIOR ART
Figure 12C:
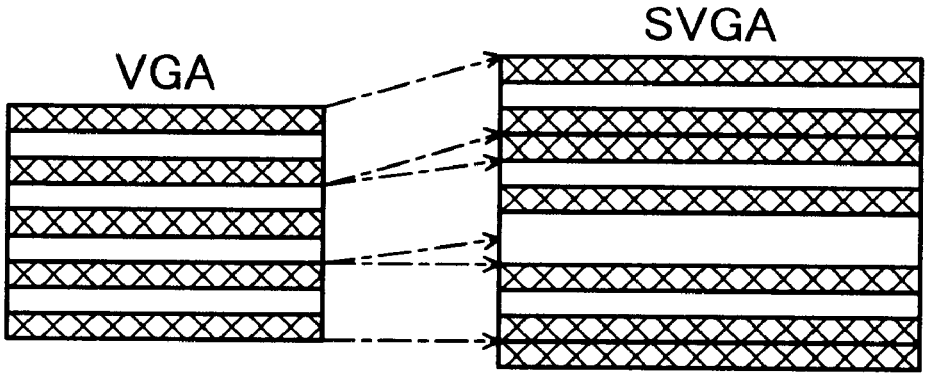
FIG.12(C) PRIOR ART

Thereby, a picture conversion shown in FIG. 3(B) is carried out, wherein the VA picture which was composed of a plurality of black and white lines from the top to the bottom is transformed into a picture which is composed of a plurality of black, white and gray lines. Therefore, a further smoother display is enabled than in the prior art case shown in FIG. 12(C).

In a case of reduction of the display lines, assume that, for example, the ratio of the number of picture lines to form a picture with video signals VA to the number of scanning lines of LCD panel 10 is 4:3. In this case, the scanning lines SL1 through SL3 makes a transition from their selected state to their non-selected state at the points t1, t3, and t5 of time in FIG. 2(B). That is, the timing of the rear edge of the scanning pulse to be provided to each of the predetermined scanning lines of all ones in the LCD panel 10 is set to the time point of renewing the display potentials of the data lines DL1 to DLn. Herein, "predetermined scanning lines" in the LCD panel 10 are ones corresponding to the reduction in a case where, for example, adjacent two picture lines of VA picture are contracted to one picture line when contracting a VA picture in order to compensate a difference between the number of scanning lines of the LCD panel 10 and the number of picture lines to form a picture with video signals VA to be displayed. In other words, the scanning line corresponding to the reduction is made transitional from its selected state to its non-selected state at the point t3 of the time when the display potentials of the data lines DL1 to DLn are changed, in order that each of the display potentials of the respective pixels of the scanning line corresponding to the reduction is made to a potential between the display potentials of the adjacent pixels on the adjacent scanning lines, preferably, made middle therebetween, that is, average thereof.

Thereby, a picture conversion shown in FIG. 3(A) is carried out, wherein the VA picture which was composed of a plurality of black and white lines from the top to the bottom is transformed into a picture which is composed of a plurality of black, gray and white lines. Therefore, a further smoother display is enabled than in the prior art case shown in FIG. 12(B).

Figure 4:
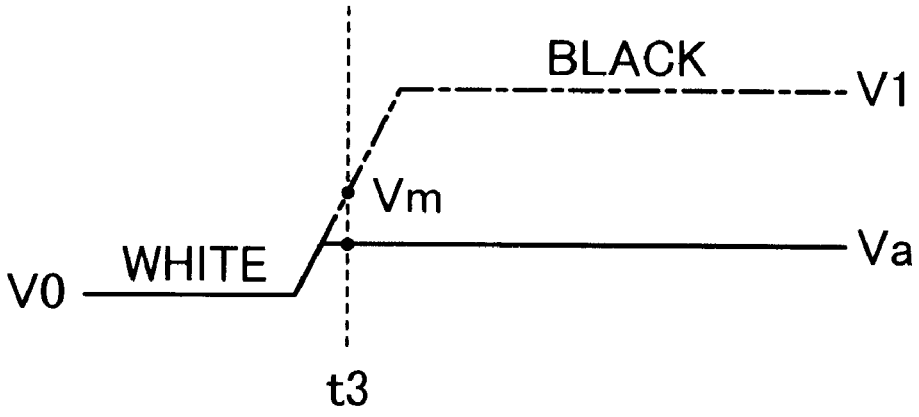
FIG. 4 is a diagram illustrating a shift of the point of display potential holding time in a case where the potential variation, at changing the display potential per cycle time of horizontal sync signal, is small.

In a case where a potential variation is small when changing the display potential on the data line DLj at every 1H, for example as shown in FIG. 4, in a case where the potential V0 is changed from V0 to Va, the potential at the point t3 of time corresponding to the average potential Vm in the case of the maximum amplitude is not made into the average of the potentials of the adjacent scanning lines. However, in this case, since the brightness change is small, the difference from this average value is small, and almost no influence arises in the picture quality.

A prototype liquid crystal display apparatus of the present application was actually produced and the above-mentioned addition and reduction of scanning lines are carried out, it was confirmed that the display was made smooth in usual picture.

Figure 5:
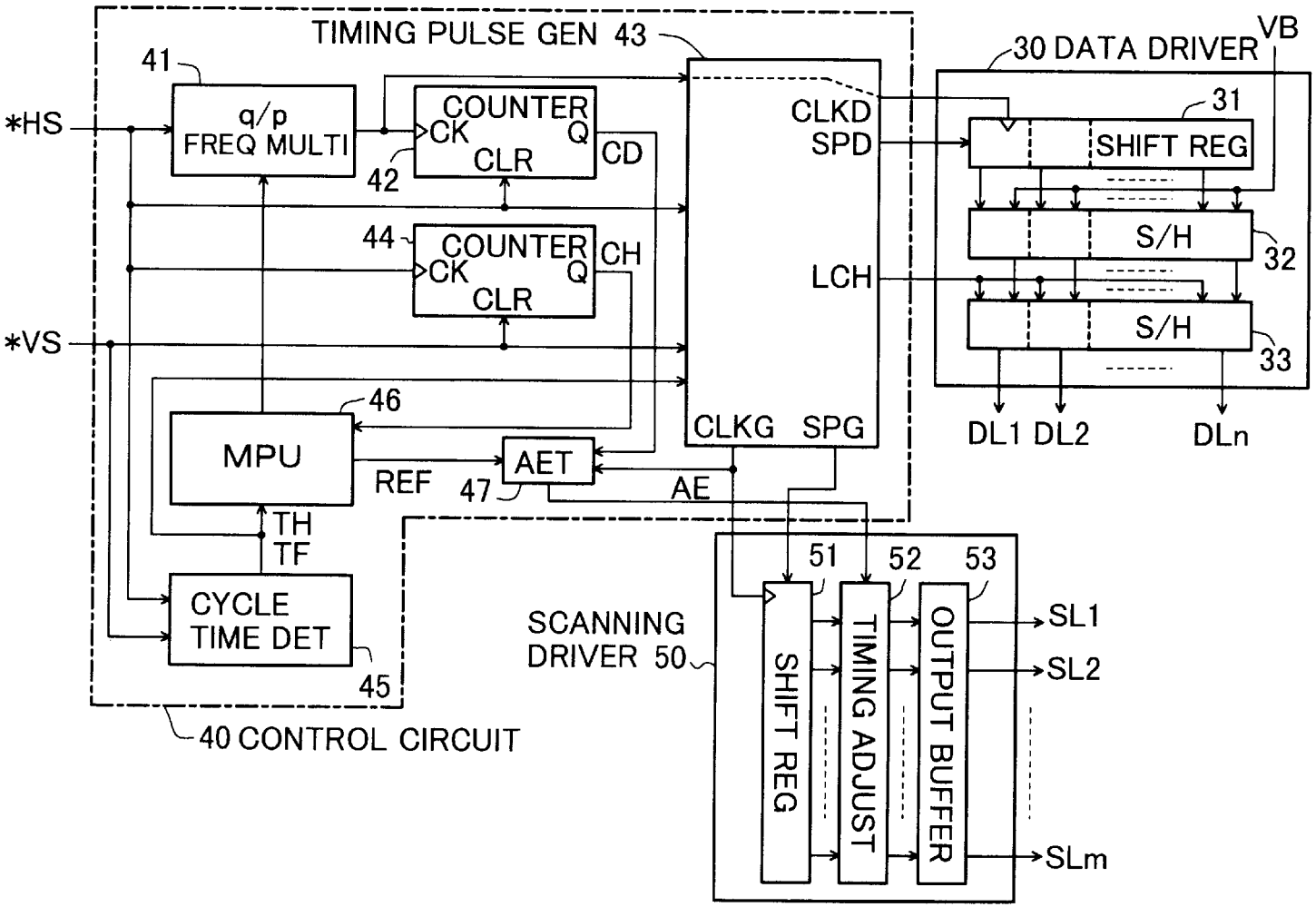
FIG. 5 is a block diagram showing an embodiment of the peripheral circuits in a liquid crystal display apparatus of FIG. 1.

FIG. 5 shows an embodiment of a peripheral circuit in the LCD panel of FIG. 1.

Figure 9:
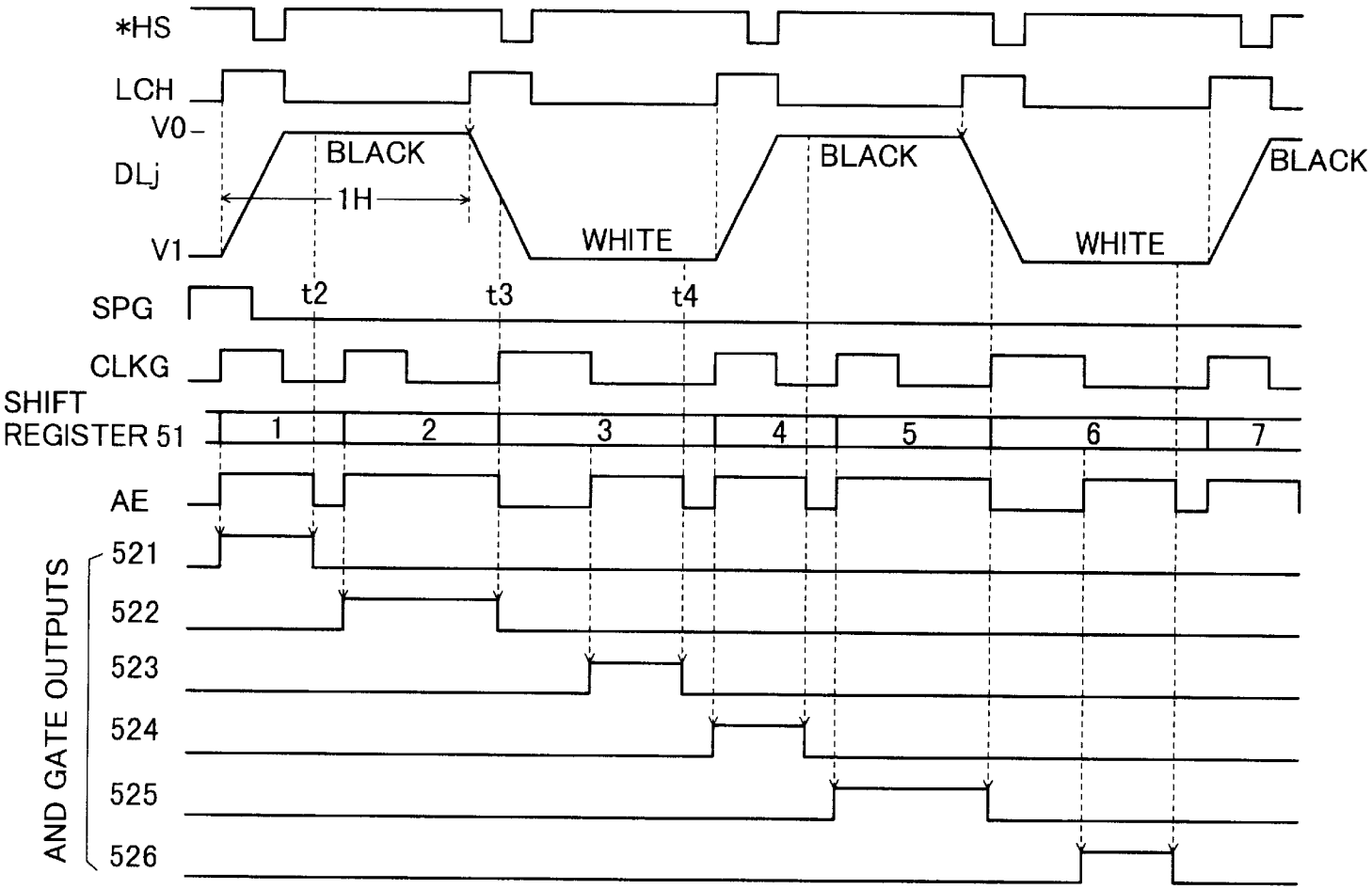
FIG. 9 is a time chart showing display operations in the display mode of three-second time enlargement.

In the data driver 30, a horizontal start pulse SPD is provided from a control circuit 40 to its serial data input in a state that a shift register 31 is cleared to zero, and bit '1' is taken into the first bit of the shift register 31 by a pixel clock CLKD from the control circuit 40. Thereafter, this bit '1' is shifted in sync with the CLKD. The number of the horizontal start pulses SPD is one for every 1H, and the number of the pixel clocks CLKD is n for every 1H regardless of the number of dots in the horizontal direction of a picture with video signals VA. A sample hold circuit row 32 is provided with n sample hold circuits, wherein video signals VB are sampled and held serially at the sample hold circuit row 32 in sync with the sampling pulses corresponding to the above bit '1' from the shift register 31. After video signals VB corresponding to one display line are held in the sample hold circuit row 32, n outputs of the sample hold circuit row 32 are simultaneously sampled into the sample hold circuit row 33 in response to a latch signal LCH such as shown in FIG. 9, coming from the control circuit 40, and are held for 1H. While they are being held, the above-mentioned operations of shift register 31 and sample hold circuit row 32 are re-performed. Thereby, a set of the display potentials of the data lines DL1 to DLn are renewed at every 1H, and, for example, in a case where black lines and white lines are alternately displayed from the top to the bottom on the screen, the display potential of the data line DLj changes as shown in FIG. 9.

In a scanning driver 50, in a state that a shift register 51 is cleared to zero, a vertical start pulse SPG is provided from the control circuit 40 to the serial data input as shown in FIG. 9 and are taken into the first bit of the shift register 51 in sync with a scanning clock CLKG such as shown in FIG. 9, coming from the control circuit 40. Thereafter, the bit '1' is shifted in sync with the CLKG. The numerical values in FIG. 9 indicate the bit position of '1' in the shift register 51. The number of the vertical start pulse SPG is one for every cycle (1V) of the vertical synchronization signal *VS, and the number of the scanning clock CLKG is m for every 1V regardless of the number of pixels in the vertical direction of a VA picture.

Figure 6:
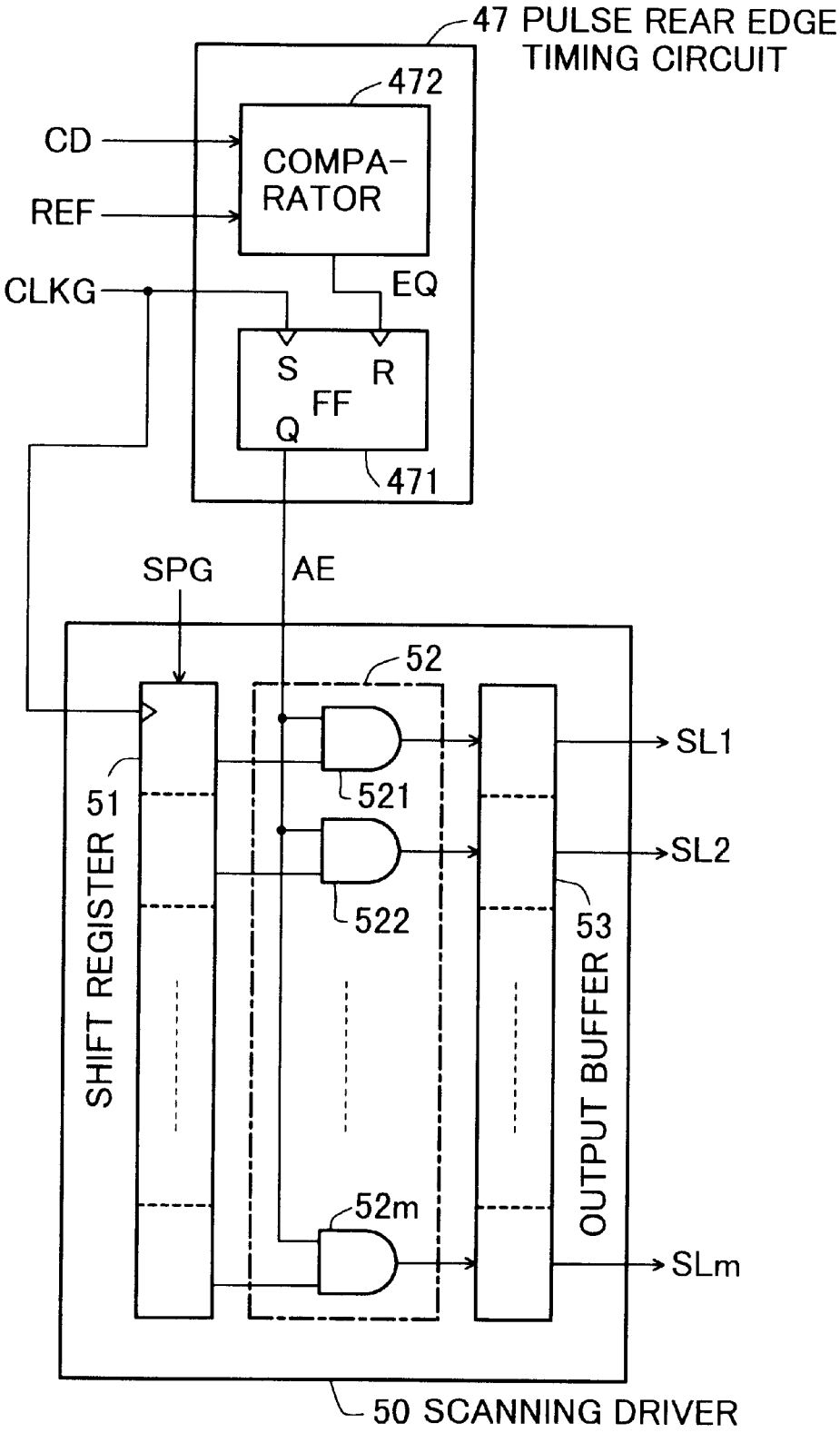
FIG. 6 is a circuit diagram showing an embodiment of a pulse rear edge timing circuit and a scanning driver in FIG. 5.

Parallel output of the shift register 51 and pulse rear edge timing signal AE coming from the control circuit 40 are provided to a timing adjustment circuit 52. As shown in FIG. 6, the timing adjustment circuit 52 is provided with AND gates 521 to 52*m*, and a pulse rear edge timing signal AE is provided to one input of each thereof while corresponding output bit of the shift register 51 is provided to the other input thereof. As described later, since the pulse rear edge timing signal AE rises in sync with a rise of the scanning clock CLKG, the output of the AND gate of the timing adjustment circuit 52 corresponding to the bit '1' in the shift register 51 becomes '1' at a rise timing of the scanning clock CLKG as shown in FIG. 9. Subsequently, the output of this AND gate becomes '0' at a fall-down timing of the pulse rear edge signal AE.

An output buffer circuit 53 is a level shift circuit which makes the selected scanning line SLi , for example, 20V, when the i-th output of the AND gate 52*i* of the timing adjustment circuit 52 is '1' and makes the non-selected scanning line SLi, for example, −5V, when the output of the AND gate 52*i* is '0'.

Figure 8:
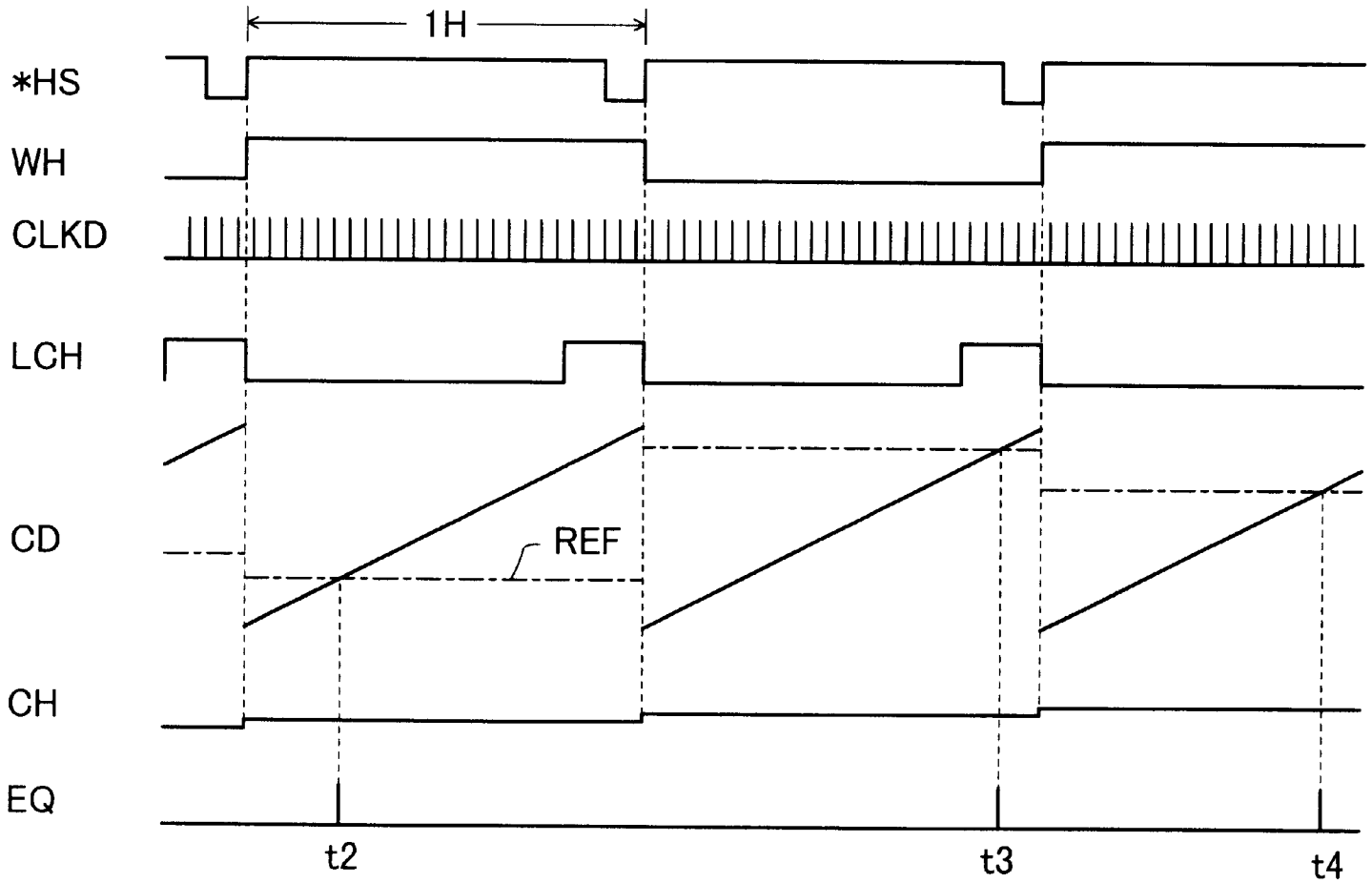
FIG. 8 is a time chart showing the operations of a control circuit.

Referring back to FIG. 5, in the control circuit 40, the frequency of a horizontal synchronization signal *HS is multiplied q/p times by a frequency q/p multiplication circuit 41 to generate the above-mentioned pixel clock CLKD, its pulses are counted by a counter 42, and its counted value is outputted as CD. The counted value CD is cleared to zero on a rise of the horizontal synchronization signal *HS. Pulses of the signal *HS are counted by a counter 44, and its counted value is outputted as CH. The counted value CH is cleared to zero by a pulse of a vertical synchronization signal *VS. Therefore, the counted values CD and CH change as shown in FIG. 8.

In a case where only a specified resolution power of a picture with video signals VA, which is different from the resolution power of the LCD panel 10, is permitted, it is possible to determine the time point of fall-down of the pulse rear edge timing signal AE if it is recognized only that the resolution power is different. However, in a case where one of a plurality of resolution powers is permitted to be selected, it is necessary to check the resolution power of a picture with video signals VA. Therefore, cycle times TF and TH of the vertical synchronization signal *VS and horizontal synchronization signal *HS are detected by a cycle time detecting circuit 45.

Figure 7:
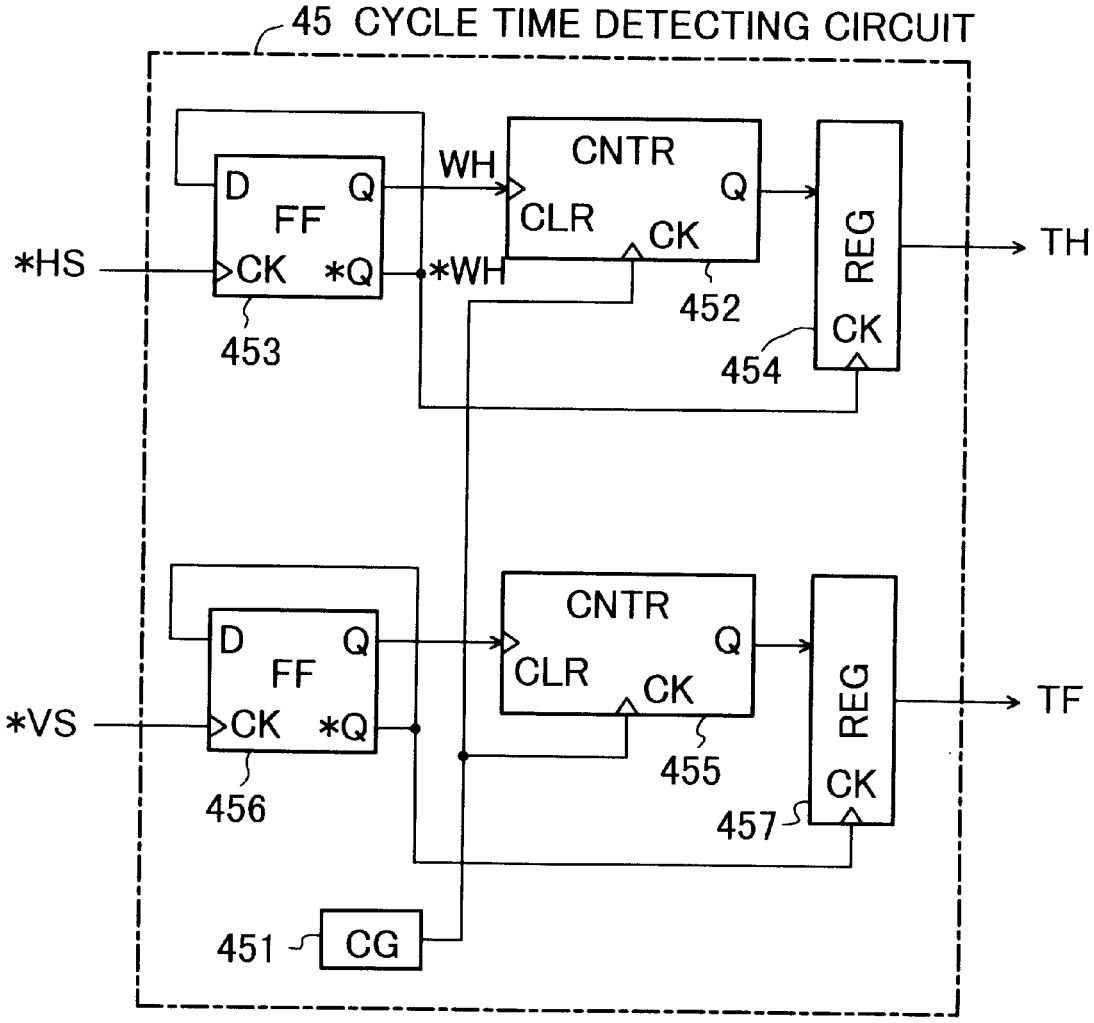
FIG. 7 is a block diagram showing an embodiment of a cycle time detecting circuit in FIG. 5.

FIG. 7 shows an embodiment of the cycle time detecting circuit 45.

Output pulses of a clock generation circuit 451 are counted by a counter 452. The frequency of horizontal synchronization signal *HS is made ½ to make a signal WH as shown in FIG. 8 by a T flip flop 453 constructed of D flip flops, and the counter 452 is cleared to zero by a rise of the signal WH, which comes from the non-reverse output Q of the T flip flop 453. And the count of the counter 452 is held in a register 454 at a rise timing of a signal *WH coming from the reverse output *Q of the T flip flop 453, whereby the cycle time TH of the horizontal synchronization signal *HS measured with output pulses of the clock generation circuit 451 is held in the register 454, and held data is renewed at every two cycles of *HS. Similarly, output pulses of the clock generation circuit 451 are counted by the counter 455, and a frequency of vertical synchronization signal *VS is made ½ by the T flip flop 456, wherein the counter 456 is cleared to zero by a rise of a signal coming from the non-reverse output Q of the T flip flop 456. And the count of the counter 455 is held in the register 457 in sync with a rise of a signal coming from the reverse output *Q of the T flip flop 456. Thereby, the cycle time TF of vertical synchronization signal *VS measured with output pulses of the clock generation circuit 451 is held in the register 457, and this is renewed at every two cycles of *VS.

Referring back to FIG. 5, MPU 46 is provided with a table ROM (not illustrated), judges the resolution power of a picture with video signals VA by comparing the horizontal cycle time TH and vertical cycle time TF coming from the cycle time detecting circuit 45 with the data in the table ROM, and, on the basis of the result, determines the q and p values to generate the above-mentioned pixel clock CLKD. The MPU 46 provides these values as set values to the frequency q/p multiplication circuit 41. Furthermore, in order to read out the reference value REF in FIG. 8 which determines the point of time when the pulse rear edge timing signal AE falls down, the MPU 46 addresses the table ROM on the basis of, for example, those results and the counted value CH at every time the counted value CH changes. The value REF is provided to the pulse rear edge timing circuit 47.

Referring back to FIG. 6, in the circuit 47, RS flip flop 471 is set by a scanning clock CLKG coming from the timing pulse generation circuit 43 of FIG. 5. The counted value CD is compared with the reference value REF by a comparator 472. When both are equal to each other, an equal signal EQ rises as shown in FIG. 8, and the RS flip flop 471 is reset. The pulse rear edge timing signal AE coming from the non-reverse output Q of the RS flip flop 471 is provided into the timing adjustment circuit 52.

In FIG. 5, the timing pulse generation circuit 43 generates the horizontal start pulse SPD and latch signal LCH on the basis of the horizontal synchronization signal *HS and pixel clock CLKD, and generates the vertical start pulse SPG and scanning clock CLKG on the basis of the vertical synchronization signal *VS, horizontal synchronization signal *HS and pixel clock CLKD.

FIG. 9 is a time chart showing operations when a picture with video signals VA is displayed on the full screen of the LCD panel 10 in a 3/2 times enlarged display mode, that is, in a case where the ratio of the number of picture lines of a picture with video signals VA to the number of scanning lines of the LCD panel 10 is 2:3.

Figure 10:
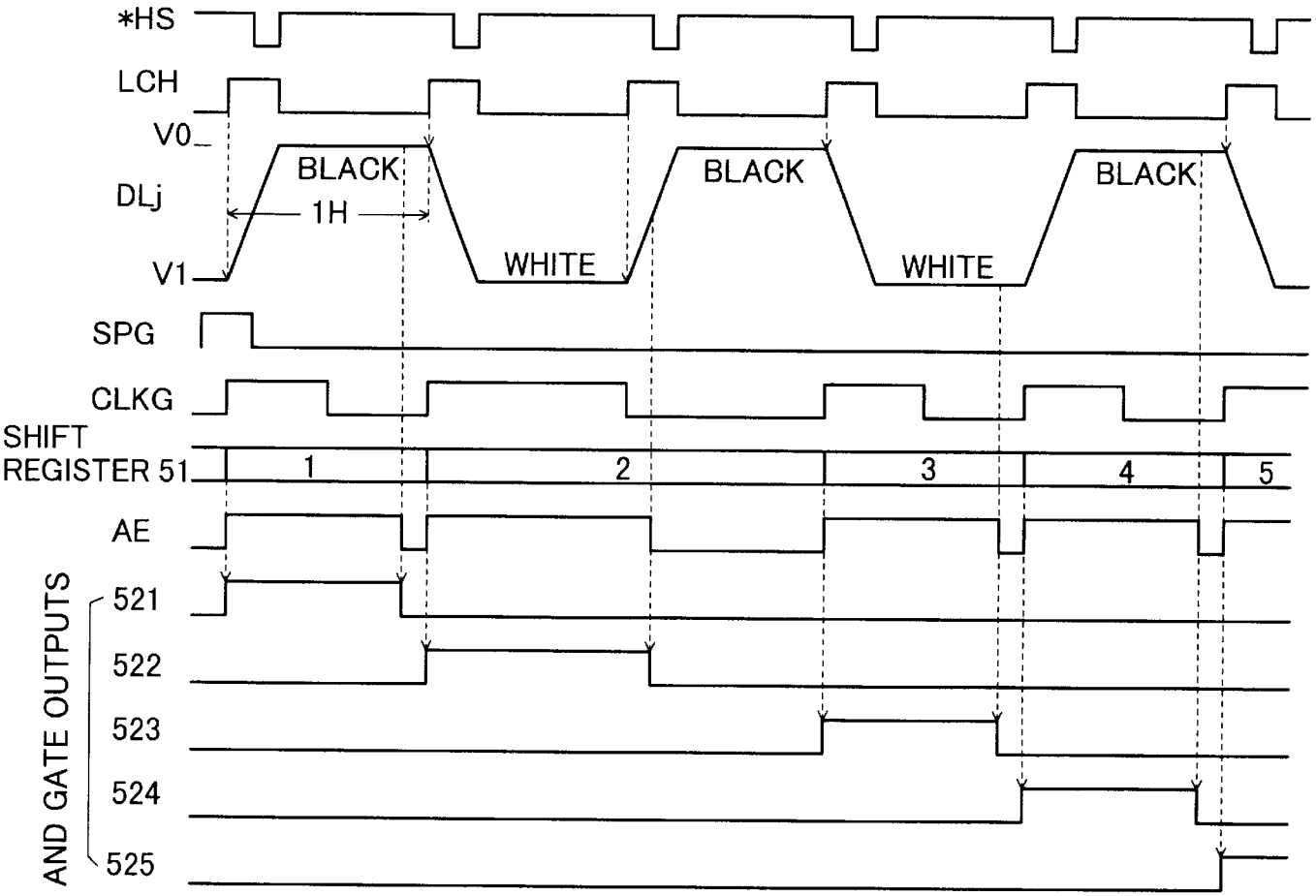
FIG. 10 is a time chart showing display operations in the display mode of three-fourth time enlargement.

FIG. 10 is a time chart showing operations when a picture with video signals VA is displayed on the full screen of the LCD panel 10 in a 3/4 times contracted display mode, that is, in a case where the ratio of the number of picture lines of a picture with video signals VA to the number of scanning lines of the LCD panel 10 is 4:3.

Second Embodiment

Figure 11:
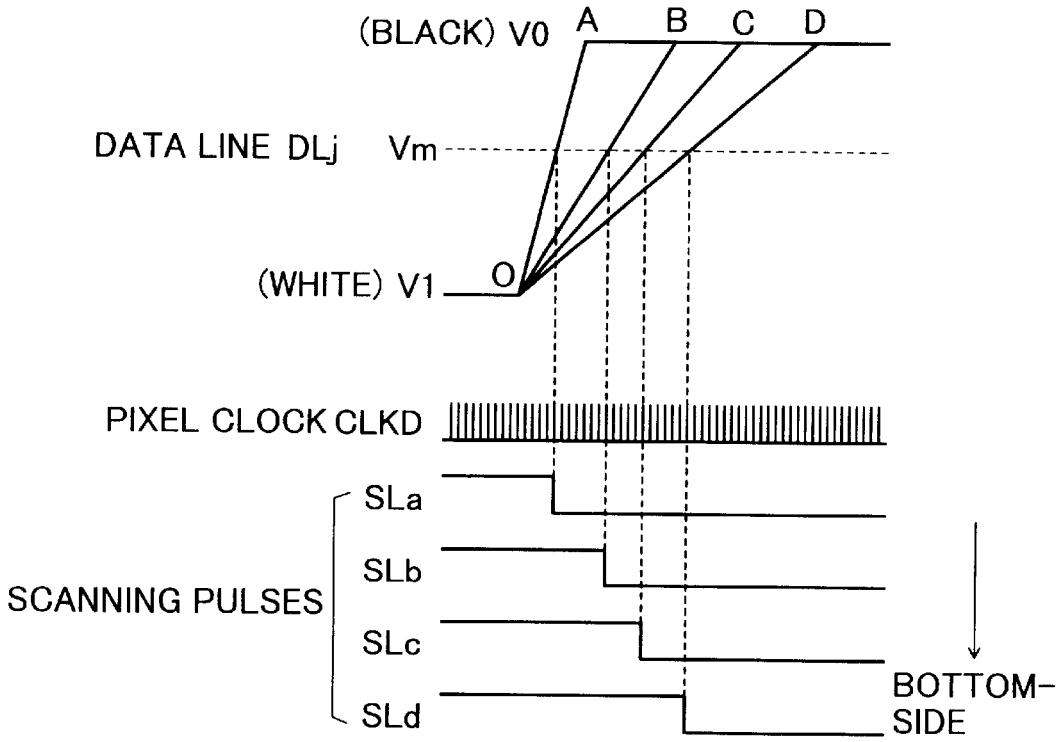
FIG. 11 is a time chart illustrating an adjustment of the time point of scanning pulse rear edge in a second embodiment of the present invention.

In FIG. 1, the longer the distance on the data line DLj between the output of data driver 30 and TFT 12 becomes, that is, the greater the value of i of the scanning line SLi becomes, a change of the display potential on the display electrode of liquid crystal pixel 11 becomes dull as shown in FIG. 11 due to an increase of parasitic capacity. In FIG. 11, the center point potential Vm is in the middle between black displaying potential V1 and white displaying potential V0, lines OA, OB, OC and OD show changes of the display electrode potential near the scanning line SLi, i=a through d (a<b<c<d), respectively. The scanning lines SLa through SLd are ones of the LCD panel 10 corresponding to picture lines added or contracted as described above.

In the second embodiment, the reference value REF outputted from the MPU 46 in FIG. 5 is determined so that as shown in FIG. 11 the rear edge of the scanning pulse provided to the scanning lines SLa through SLd are made coincident with the points of time when potentials on the respective lines OA, OB, OC and OD become the center Vm, whereby when a difference shown in FIG. 11 can not be ignored, the display is made smoother than in the case of the first embodiment.

All the other points are identical to those in the first embodiment.

Although preferred embodiments of the present invention has been described, it is to be understood that the invention is not limited thereto and that various changes and modifications may be made without departing from the spirit and scope of the invention.

For example, the present invention may be applicable to a case where a picture is displayed not on the full but a part of screen of the LCD panel 10 with enlarging or contracting the picture, or only a part of the picture is enlarged or contracted.

Furthermore, since the present invention is characterized in the control circuit 40, any one or both of video signals VA and VB may be digital signals.

In FIG. 5, the present invention may be such that the counter 44 is omitted, a horizontal synchronization signal *HS and a vertical synchronization signal *VS is provided to the MPU 46, the reference value REF is renewed at every pulse of the horizontal synchronization signal *HS, and this is repeated with a cycle of the vertical synchronization signal *VS. Furthermore, it may be such that the output of the cycle time detecting circuit 45 is converted to a resolution power identification code, the same and the count CH addresses a table ROM to read out the reference value REF. A resolution power identification code provided from a signal VA providing side computer (not shown in figures) may be used without use of the cycle time detecting circuit 45.

Still furthermore, the present invention may be applied to the LCD apparatus using other than frame reversing method in which the video signals VB is reversed at every frame.

What is claimed is:

1. A liquid crystal display apparatus, comprising:

an active matrix type liquid crystal panel in which potentials of respective data lines are applied to respective display electrodes of a selected display line via respective switching devices of said selected display line, said selected display line corresponding to a selected one of scanning lines connected to control inputs of said switching devices;

a data driver for applying said potentials to said respective data lines and renewing said potentials at every horizontal cycle;

a scanning driver for providing scanning pulses to said respective scanning lines in line-sequence; and a control circuit for causing a timing of a rear edge of a scanning pulse provided to a predetermined scanning line to coincide with a time when said potentials of said data lines are in transition from last values to next values, such that latched potentials of said display electrodes corresponding to said predetermined scanning line, having values corresponding to said potentials of said data line during said transition, are values higher than one of two scanning lines adjacent to said predetermined scanning line and lower than the other of the two scanning lines adjacent to said predetermined scanning line;

wherein said predetermined scanning line is one corresponding to an addition of picture line to or a reduction of picture line from a picture to be displayed, in order to compensate for a difference between a number of said scanning lines and that of picture lines of said picture to be displayed.

2. A liquid crystal display apparatus according to claim 1, wherein said control circuit comprises:

a first counter counting pulses of a clock signal and initialized by a horizontal synchronization pulse; and a pulse rear edge timing circuit for setting said timing of said rear edge at a time when a count of said first counter is equal to a first value.

3. A liquid crystal display apparatus according to claim 2, wherein said clock signal is a pixel clock signal.

4. A liquid crystal display apparatus according to claim 2, wherein said control circuit further comprises:

a second counter counting said horizontal synchronization pulses and initialized by a vertical synchronization pulse; and wherein said pulse rear edge timing circuit executes said setting when a count of said second counter is equal to a second value.

5. A liquid crystal display apparatus according to claim 4, further comprising a reference value determination circuit for detecting cycle times of said horizontal synchronization pulse and said vertical synchronization pulse and for determining said first value on the basis of the detected cycle times and a count of said second counter.

6. A liquid crystal display apparatus according to claim 2, wherein said scanning driver comprises:

a shift register in which a selection bit is shifted by one bit at every scanning pulse;

an output buffer circuit having outputs connected to respective said scanning lines; and a timing adjustment circuit for determining an output of said output buffer circuit on the basis of a parallel output of said shift register and an output of said pulse rear edge timing circuit.

7. A liquid crystal display apparatus according to claim 6, wherein said timing adjustment circuit causes said output buffer circuit to generate said scanning pulse corresponding to a bit of said parallel output when this bit becomes said selected bit and to disappear said scanning pulse at a rear edge of an output of said pulse rear edge timing circuit.

8. A liquid crystal display apparatus according to claim 1, wherein said timing in said control circuit approximately coincides with a time point when said display potential becomes the center between the maximum and minimum display potentials in a same polarity.

9. A control circuit for use in a liquid crystal display apparatus including an active matrix type liquid crystal panel in which potentials of respective data lines are applied to respective display electrodes of a selected display line via respective switching devices of said selected display line, said selected display line corresponding to a selected one of scanning lines connected to control inputs of said switching devices, wherein said control circuit causes a timing of a rear edge of a scanning pulse provided to a predetermined scanning line to coincide with a time when potentials of data lines are in transition from last values to next values, such that latched potentials of said display electrodes corresponding to said predetermined scanning line, having values corresponding to said potentials of said data line during said transition, are values higher than one of two scanning lines adjacent to said predetermined scanning line and lower than the other of the two scanning lines adjacent to said predetermined scanning line;

wherein said predetermined scanning line is one corresponding to an addition of picture line to or a reduction of picture line from a picture to be displayed, in order to compensate a difference between a number of said scanning lines and that of picture lines of said picture to be displayed.

10. A method of driving a liquid crystal display panel, comprising the steps of:

providing an active matrix type liquid crystal panel in which potentials of respective data lines are applied to respective display electrodes of a selected display line via respective switching devices of said selected display line, said selected display line corresponding to a selected one of scanning lines connected to control inputs of said switching devices;

applying said potentials to said respective data lines and renewing said potentials at every horizontal cycle;

providing scanning pulses to said respective scanning lines in line-sequence; and causing a timing of a rear edge of a scanning pulse provided to a predetermined scanning line to coincide with a time when said potentials of said data lines are in transition from last values to next values, such that latched potentials of said display electrodes corresponding to said predetermined scanning line, having values corresponding to said potentials of said data line during said transition, are values higher than one of two scanning lines adjacent to said predetermined scanning line and lower than the other of the two scanning lines adjacent to said predetermined scanning line;

wherein said predetermined scanning line is one corresponding to an addition of picture line to or a reduction of picture line from a picture to be displayed, in order to compensate a difference between a number of said scanning lines and that of picture lines of said picture to be displayed.

11. A method according to claim 10, wherein the step of said causing includes the steps of:

initializing a first count with a horizontal synchronization pulse and counting clock pulses to get said first count;

initializing a second count with a vertical synchronization pulse and counting said horizontal synchronization pulses to get said second count; and setting said timing of said rear edge at a time when said first and second counts become first and second values, respectively.

12. A method according to claim 11, wherein the step of said causing further includes the steps of:

detecting cycle times of said horizontal synchronization pulse and said vertical synchronization pulse; and determining said first value on the basis of the detected cycle times and said second count.

13. A method according to claim 11, wherein said timing in the step of said setting approximately coincides with a time point when said display potential becomes the center between the maximum and minimum display potentials in a same polarity.

* * * * *